US005618353A

United States Patent [19]

Irvine et al.

[11] Patent Number: 5,618,353

[45] Date of Patent: Apr. 8, 1997

[54] CLEANING, METHOD FOR CLEANING INTERNAL AIRFOIL COOLING PASSAGES

[75] Inventors: Jeffrey D. Irvine, Whitehall; Jeffery S. Smith, Muskegon; Patrick L. Conroy, Montague, all of Mich.

[73] Assignee: Howmet Corporation, Greenwich, Conn.

[21] Appl. No.: 455,343

[22] Filed: May 31, 1995

Related U.S. Application Data

[62] Division of Ser. No. 173,578, Dec. 23, 1993, Pat. No. 5,507,306.

[51] Int. Cl.[6] ..... B08B 9/00; B08B 3/08

[52] U.S. Cl. ..... 134/22.17; 134/22.18; 134/22.19; 134/29

[58] Field of Search ..... 134/22.17, 22.18, 134/22.19, 25.1, 25.4, 25.3, 24, 29

[56] References Cited

U.S. PATENT DOCUMENTS

| | | | |
|---|---|---|---|
| 1,492,924 | 5/1924 | Knight | 134/24 |
| 2,644,472 | 7/1953 | Ward | 134/56 |
| 2,671,742 | 3/1954 | Cozzoli | 134/25.4 |
| 2,786,480 | 3/1957 | Hofer | 134/171 X |
| 3,020,025 | 2/1962 | O'Mara | 366/147 |
| 3,070,104 | 12/1962 | Faust et al. | 134/171 X |
| 3,121,026 | 2/1964 | Beigay | 134/2 |
| 3,421,840 | 1/1969 | Pechmann | 134/24 |
| 3,590,863 | 7/1971 | Faust | 134/144 |
| 3,845,940 | 11/1974 | Lodge et al. | 366/147 |
| 4,134,777 | 1/1979 | Borom | 134/2 |
| 4,141,781 | 2/1979 | Greskovich et al. | 156/637 |
| 4,143,669 | 3/1979 | Minkin | 134/153 |
| 4,213,475 | 7/1980 | Minkin | 134/111 |
| 4,233,676 | 11/1980 | Lucke et al. | 366/147 |
| 4,439,241 | 3/1984 | Ault et al. | 134/22.17 |
| 4,741,351 | 5/1988 | Minkin | 134/144 |
| 4,931,104 | 6/1990 | Burke | 134/22.18 X |
| 5,409,545 | 4/1995 | Levey et al. | 134/22.18 |

*Primary Examiner*—Jill Warden
*Assistant Examiner*—Saeed Chaudhry
*Attorney, Agent, or Firm*—Edward J. Timmer

[57] ABSTRACT

A plurality of engine-run components are fixtured on a cleaning fluid manifold disposed in a cleaning chamber with the internal passage of each component communicated to a respective fluid spray nozzle on the cleaning fluid manifold, a heated caustic cleaning fluid is pumped to the manifold for flow through the nozzle and then the internal passage of each component for a time to remove the deposits, and the heated cleaning fluid is discharged from each component into the cleaning chamber.

14 Claims, 7 Drawing Sheets

CLEANING, METHOD FOR CLEANING INTERNAL AIRFOIL COOLING PASSAGES

This is a division of Ser. No. 08/173 578, filed Dec. 23, 1993now U.S. Pat. No. 5,507,306.

FIELD OF THE INVENTION

The present invention relates to the repair of engine-run gas turbine engine components and, more particularly, to cleaning of an internal passage of engine-run airfoil components to remove built-up deposits in the passage.

BACKGROUND OF THE INVENTION

In use in a gas turbine engine, airfoil components, such as gas turbine engine blades and vanes, are operated at extremely elevated temperatures and as a result are internally cooled by ducted airflow through one or more cooling passages located internally in the airfoil. Such components typically are externally coated with a protective coating that is resistant to high temperature degradation. The walls of the internal passages of such components also typically can be protectively coated to this same end. Over time, such airfoil components exhibit coating wear, cracking, corrosion, and other degradation to the coating and/or airfoil substrate that necessitates repair or replacement of the component. Repair, rather than replacement, is the preferred procedure for extending the service life of such components from an economic standpoint due to their high initial cost.

In typical repair procedures, engine-run airfoil components are subjected to external and possible internal recoating with protective coating materials using well known high temperature coating techniques, such as pack, out-of-pack, chemical vapor deposition, or plasma spray coating to form protective external and internal coatings. It is important prior to such coating operations that any deposits of foreign material accumulated or built-up an the external and/or internal surfaces of such airfoil components be removed to avoid harmful metallurgical contamination of the repaired airfoil component. Dirt build-up reduces airflow cooling which can create a "hot spot" in the airfoil, possibly resulting in blade failure. Removal of deposits from external surfaces of engine-run airfoil components is readily achieved as a result of the accessibility of the external surfaces to chemical cleaning agents, such as caustic solutions, or to grit blasting agents. However, removal of deposits from internal passages of engine-run airfoil components is rendered difficult by virtue of their small size and oftentimes convoluted nature that can hinder access of cleaning solution throughout the passage.

One technique developed to remove difficult-to-access internal passages of engine-run airfoil components employs a high pressure autoclave procedure wherein the engine-run components to be cleaned are disposed inside an autoclave containing a caustic cleaning solution, such as an aqueous 45% KOH solution. The autoclave is heated to elevated temperature greater than 400° F. and pressurized to 200 psi for a prolonged time (e.g. 8–24 hours) to remove deposits from the internal airfoil passages. However, this autoclave procedure may not be effective to adequately remove heavy deposits from the internal airfoil passages such that the components are scrapped rather than subjected to remaining repair operations that would enable reuse of the repaired component in gas turbine engine service.

SUMMARY OF THE INVENTION

The present invention provides in one embodiment a method for removing deposits from one or more internal passages of a plurality of engine-run components, such as airfoil components, in a rapid, reliable manner. In this embodiment of the invention, the method comprises fixturing a plurality of engine-run components on a cleaning fluid manifold with the internal passage of each component communicated to a respective cleaning fluid spray nozzle on the cleaning fluid manifold, pumping a heated cleaning fluid to the manifold for flow through the nozzle and the internal passage of each component for a time to remove the deposits, and discharging the heated cleaning fluid from each component into a cleaning chamber in which the manifold is disposed.

Preferably, the heated cleaning fluid is pumped through each internal passage at a flow rate between 7.5 and 20 gallons per minute and a pressure of between 200 to 400 psi. The heated cleaning fluid preferably comprises an aqueous alkali metal earth hydroxide solution (e.g. KOH or NaOH) maintained below the solution boiling point.

In another embodiment of the present invention for removing deposits from internal passages of a plurality of engine-run components, the cleaning fluid is pumped from a sump of the cleaning chamber to the cleaning fluid manifold for flow through a respective spray nozzle and the internal passage of each component communicated therewith on the manifold. The cleaning fluid is discharged from each component into the sump for pumping back to the cleaning fluid manifold, providing a closed-loop cleaning system.

The present invention also provides apparatus for removing deposits from one or more internal passages of a plurality of engine-run components. The apparatus comprises in one embodiment a cleaning chamber having a cleaning fluid manifold with a plurality of cleaning fluid spray nozzles spaced apart thereon, fixturing means for positioning a plurality of the engine-run components on the cleaning fluid manifold with the internal passage of each component communicated to a respective nozzle on the cleaning fluid manifold, and pumping means for pumping cleaning fluid to the cleaning fluid manifold for flow through each respective nozzle and the internal passage of each component for a time to remove the deposits. The cleaning fluid is discharged from each component into the cleaning chamber.

In another apparatus embodiment of the invention, pumping means is provided for pumping the cleaning fluid from a sump of the cleaning chamber to the cleaning fluid manifold for flow through each respective spray nozzle and the internal passage of each component for a time to remove the deposits. The cleaning fluid discharged from each component is collected in the sump of the cleaning chamber for pumping back to the cleaning fluid manifold. A closed loop cleaning fluid path is thereby provided.

The invention will be described in more detail by the following drawings and detailed description.

DETAILED DESCRIPTION

Figure 1:
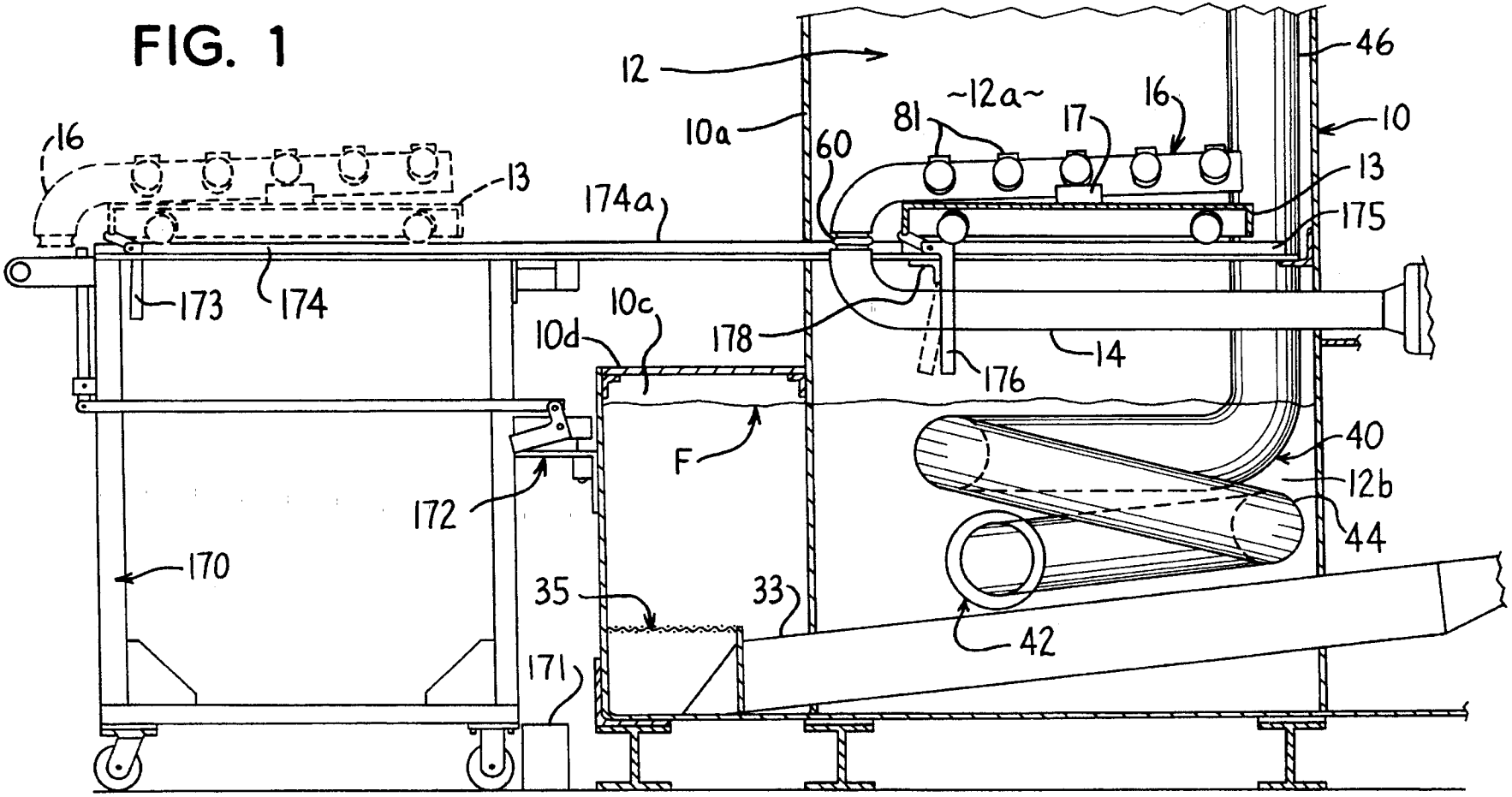
FIG. 1 is an elevational view of apparatus in accordance with one embodiment of the invention for removing deposits from internal passages of airfoil components wherein the apparatus housing is shown sectioned to reveal the components of the invention disposed therein.

Referring to FIGS. 1–5 and 7, apparatus in accordance with one embodiment of the invention for removing deposits from one or more internal passages of a plurality of engine-run airfoil superalloy components A is illustrated. The apparatus comprises a housing 10 defining a cleaning chamber 12 therein openable/closeable by door 11 pivotable about pivot 11*a*. The cleaning chamber 12 includes a cleaning region 12*a* and a sump region 12*b* underlying the cleaning region 12*a*. An ambient vent (not shown) is disposed on the top of the housing 10 above the cleaning region 12*a*.

The cleaning region 12*a* includes a fixed cleaning fluid supply conduit 14 to which a cleaning fluid manifold 16 can be releasably connected to receive pressurized cleaning fluid from pumping means 20 as described below. The housing 10 includes the pivotable door 11 that is openable to allow the manifold 16 to be positioned inside the cleaning region 12*a* and closeable (sealable) against the front housing wall 10*b* to close off housing front opening 10*a* during the cleaning operation when cleaning fluid is pumped through the manifold 16. The forward housing chamber 10*c* typically is closed off by a suitable cover 10*d* during the cleaning operation. The cover can be removed to provide access to filter screen 35.

Supported on the housing 10 are a first relatively low pressure pump 30 (e.g. a 25 horsepower electric pump) and a second relatively high pressure pump 32 (e.g. a 150 horsepower electric pump) positioned in tandem manner such that the pump 30 draws cleaning fluid F from the sump region 12*b* through a conduit 33. The conduit 33 includes a stainless steel screened region 35 to remove foreign matter particulates from the cleaning fluid drawn from the sump region 12*b*. The low pressure pump 30 supplies the cleaning fluid to the second high pressure pump 32 via conduit 37 that, in turn, supplies pressurized cleaning fluid to the fixed supply conduit 14 in the cleaning region 12*a* for flow through the manifold 16. A closed-loop, recirculating cleaning fluid system is thereby provided.

As will be explained below, the sump region 12*b* receives cleaning fluid discharged from the engine-run airfoil superalloy components after flowing therethrough to remove the deposits. As a result, the cleaning fluid discharged to the sump region 12*b* includes foreign matter attributable to the deposits removed from the superalloy components A, shown in FIGS. 4–5. As mentioned, the conduit 33 draws cleaning fluid from a screened region 35 to remove such foreign matter.

Figure 2:
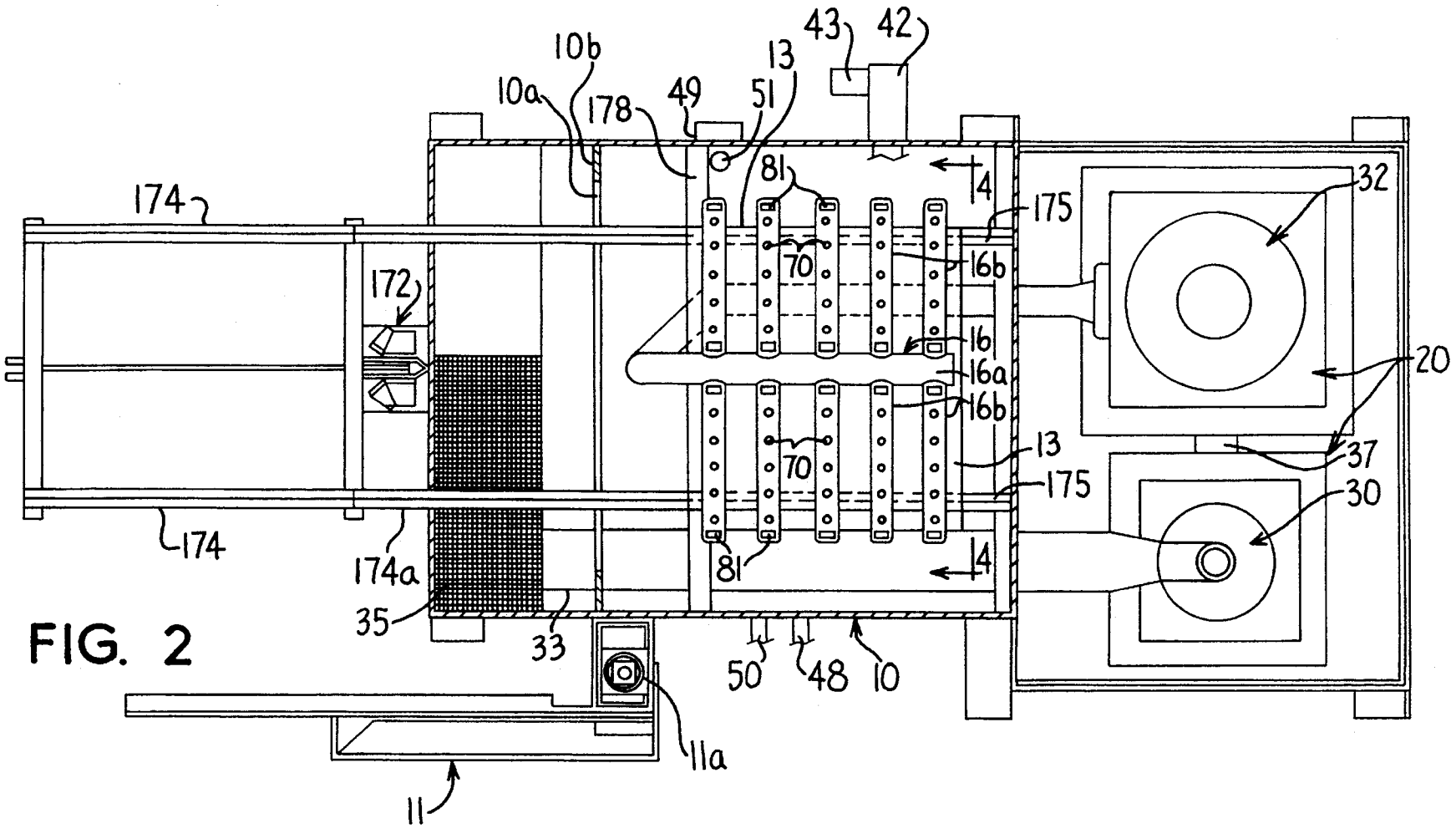
FIG. 2 is a plan view of the apparatus of FIG. 1 with the top of the housing not shown to illustrate the cleaning fluid manifold therein (shown without airfoil components A and fixture components thereon for clarity). The cleaning fluid heat exchanger is omitted in this figure for clarity.

As shown in FIGS. 1–2, proximate the bottom of the sump region 12*b* is disposed a cleaning fluid heating device 40 to heat the cleaning fluid to the desired temperature for deposit removal. The heating device 40 comprises a gas fired burner 42 and blower 43 (shown schematically) disposed externally of the housing 10 to provide hot gas flow to a serpentine heat exchanger 44 submerged in the cleaning fluid F residing within the sump region 12*b*. The hot gases are exhausted to ambient via exhaust pipe 46.

Also located proximate the bottom of the sump region 12*b* is a hot water inlet conduit 48. The hot water conduit 48 is connected to a conventional hot water heater (not shown) to provide makeup hot water for direct discharge to the sump region 12*b* in response to a cleaning fluid float level sensor (not shown) in the sump region 12*b*. The makeup water is added to counter evaporative loss of the water (as steam) during the cleaning operation based on the assumption that the majority of cleaning fluid level F drop in the sump region 12*b* is due to steam evaporation since the fluid temperature is maintained below its boiling point.

A rinse water pump 49 is provided to supply water to an upstanding rinse water conduit 51 that supplies the water to a spray bar (not shown) disposed proximate the top of the housing 10 above the chamber 12*a* and extending diagonally thereacross. The spray bar includes a plurality of water spray nozzles (not shown) for directing water onto the underlying manifold 16 and airfoil components A thereon to rinse them after the engine-run airfoil components A are cleaned of deposits. The rinse water is sprayed to rinse off exterior surfaces of the airfoil components A and manifold 16.

Figure 3:
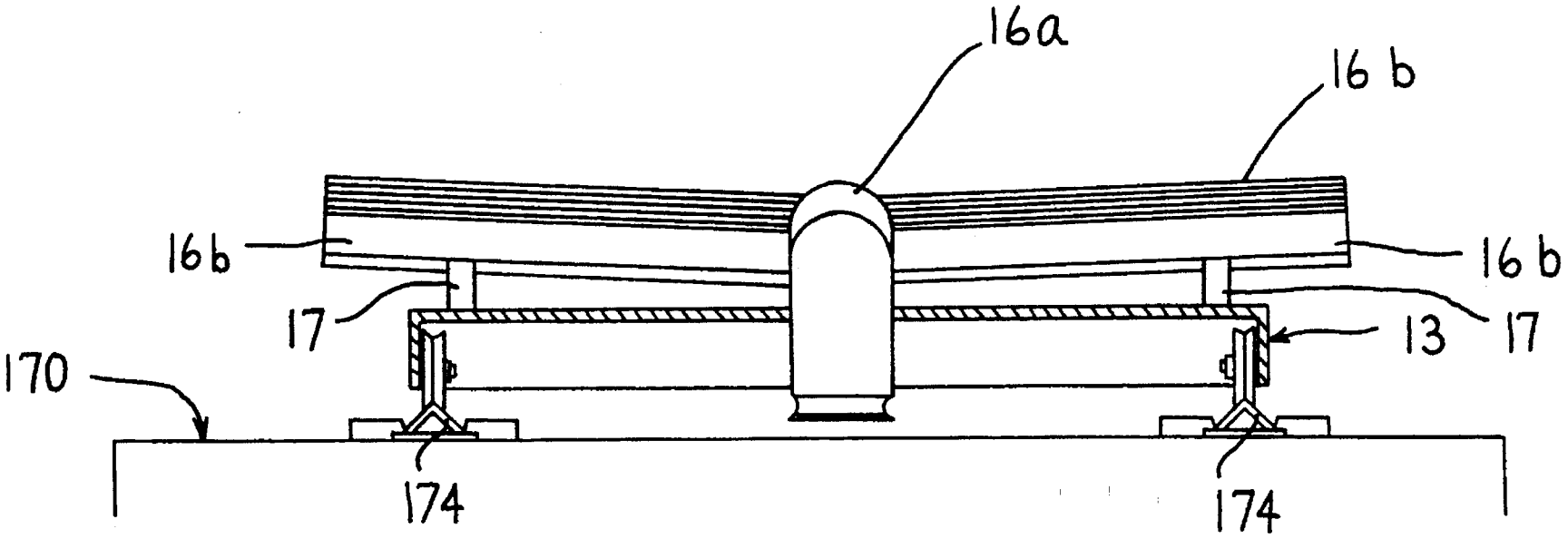
FIG. 3 is an end elevation of the cleaning fluid manifold on the trolley (the fixture support blocks 81 not shown for convenience).

In FIG. 1, the cleaning fluid manifold 16 is shown positioned on a wheeled trolley 13 in the cleaning region 12*a* and connected in fluid communication to the fixed cleaning fluid supply conduit 14 that receives pressurized cleaning fluid from the pump 32. The manifold 16 includes a main manifold section 16*a* that is releasably connected by a releasable flange clamp 60 to the fixed supply conduit 14 and a plurality of secondary lateral manifold sections 16*b* on which the engine-run airfoil components A are fixtured for cleaning. The manifold sections 16*b* are welded on the manifold section 16*a*. As shown in FIGS. 1 and 3, the manifold sections 16*a*, 16*b* are supported by supports 17 on the trolley 13 so as to be inclined (e.g. 2.5°) relative to horizontal to provide drainage of cleaning solution therefrom to supply conduit 14 when the manifold is unpressurized.

The cleaning fluid manifold sections 16*b* include a plurality of apertures 70 spaced apart thereon. The apertures 70 receive respective cleaning fluid spray nozzles 71 that are mounted on the manifold sections 16*b* by, for example, threading in apertures 70. The nozzles 71 receive cleaning fluid from the manifold 16 at one nozzle end and direct the cleaning fluid at the other nozzle end toward the internal passage P of the airfoil component A fixtured in registry and communicated therewith, FIGS. 4–5. In particular, each spray nozzle 71 is communicated to the proximate open end OE of the internal passage P (shown schematically) of each airfoil component A. The nozzles 71 are sized to provide a selected cleaning fluid flow rate (gallons per minute) to the internal passage P registered therewith. The spray nozzles 71 shown are available under designation washjet solid stream 0° (zero degree) nozzles from Spraying Systems Co., North Ave., Wheaton, Ill. 60188.

Figure 4:
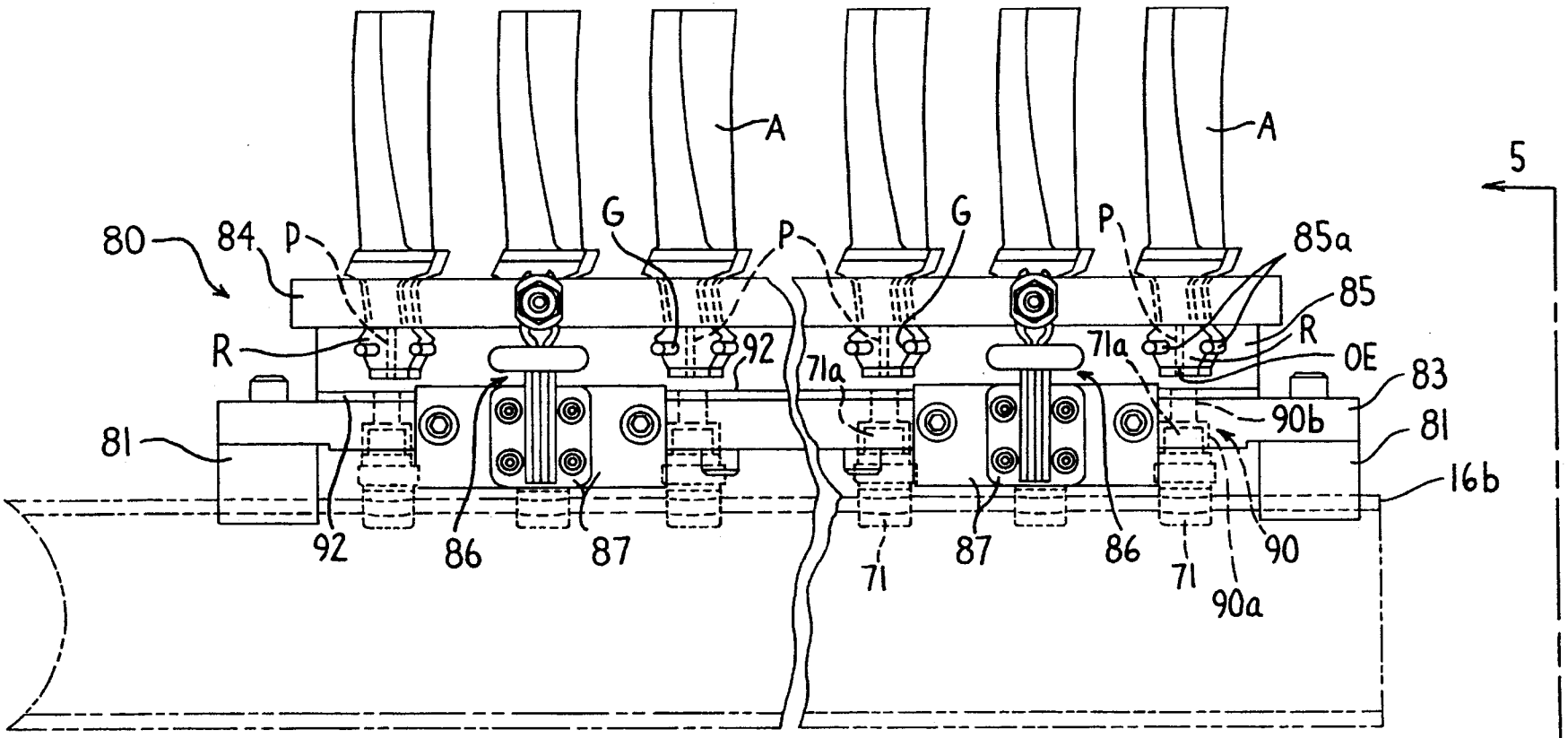
FIG. 4 is an elevational view of the airfoil components and fixturing therefor on the cleaning fluid secondary manifold section (taken in the direction of lines 4—4 of FIG. 2).
Figure 5:
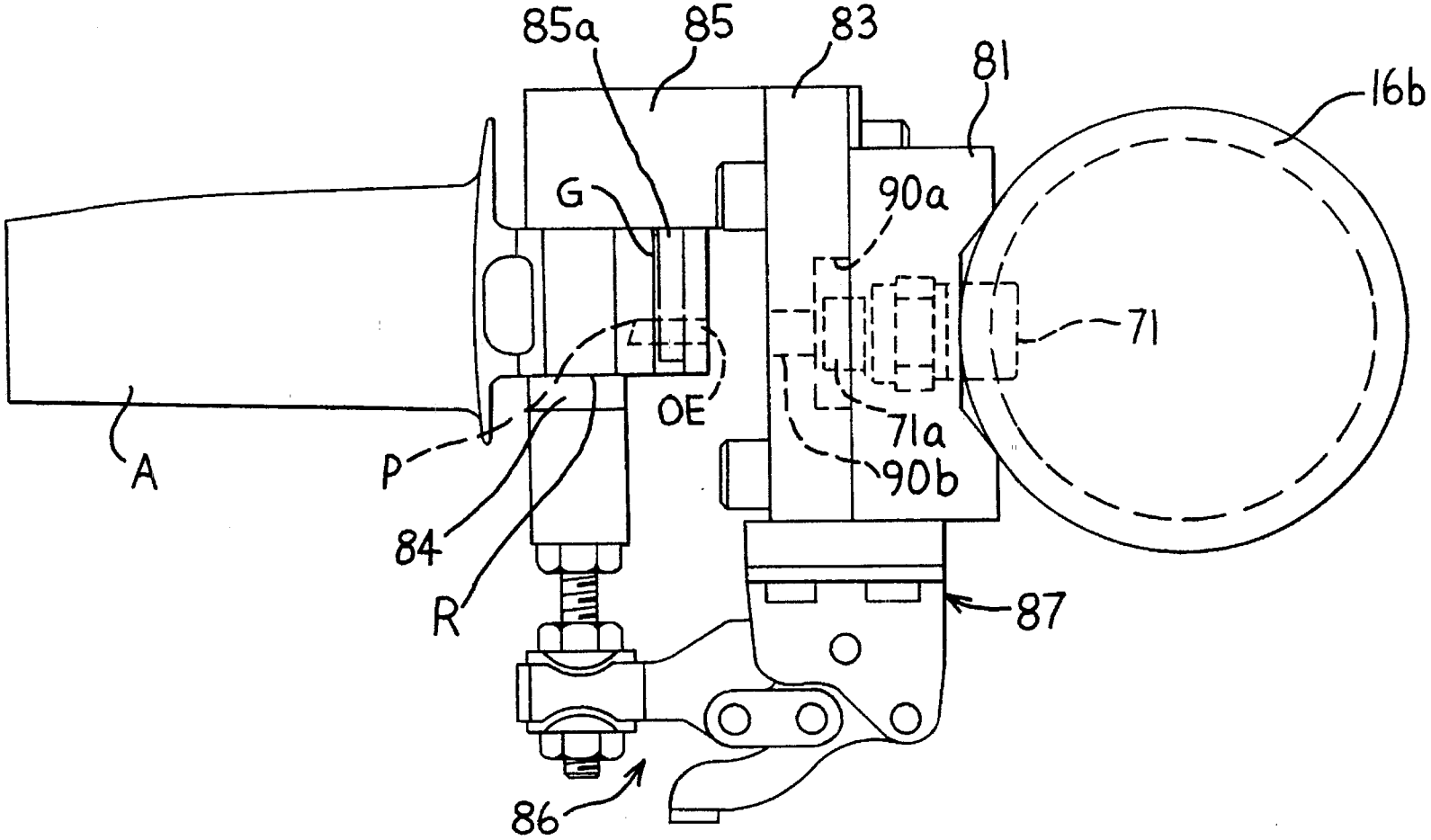
FIG. 5 is a view in the direction of lines 5—5 of FIG. 4.

Since the open end OE of the internal passage P to be cleaned typically is disposed at the root end R of the airfoil component A, the airfoil components A are each fixtured on the manifold sections 16*b* with the root end R proximate to the discharge end 71*a* of the associated spray nozzle 71 as shown in FIGS. 4–5. Although the discharge ends 71*a* of the nozzles 71 are shown spaced from the open passage end OE, they can be abutted against root R or received therein depending on the relative spray size of the nozzle and the size of open passage end OE so as to communicate each nozzle discharge end 71*a* and open passage end OE.

The fixtures 80 used to fixture the airfoil components A on the manifold sections 16*b* are mounted on support blocks 81 attached to opposite ends of the manifold sections 16*b*.

Each fixture 80 is identical and only one is shown in FIGS. 4–5 disposed on a secondary manifold section 16*b*. Each fixture 80 comprises end plates 81 and an elongated base plate 83 that overlies the respective manifold section 16*b*. An upstanding stop member 85 is disposed on base plate 83. The stop member 85 includes a plurality of pairs of pins 85*a* that engage grooves G in the root R of each airfoil component A as shown best in FIG. 4.

An elongated clamp member 84 is connected to a pair of toggle clamps 86 (one shown proximate each end of base plate 83). The toggle clamps 86 are operable to cause clamp member 84 to engage and clamp the roots R of the airfoil components A on the sides remote from the pins 85*a*. The toggle clamps 86 are supported by mountings 87 screwed to the base plate 83. The toggle clamps 86 are of conventional type and available under designation 305 clamp from De-Sta-Co, A Dover Resources Company, 250 Park Street, P.O. Box 2800, Troy, Mich. 48007.

The base plate 83 overlies the manifold section 16*b* and includes apertures 90 in registry with the nozzle discharge end 71*a* therebelow. Each aperture 90 includes a larger diameter aperture region 90*a* receiving the nozzle discharge end 71*a* and communicated to a smaller diameter aperture region 90*b* having the open end OE of the passage P aligned thereabove.

As shown in FIG. 4, an optional masking insert 92 (hardened stainless steel) can be disposed on base plate 83 above the nozzle ends 71*a* and can be sized to prevent overspray of cleaning fluid onto exterior root surfaces.

Cleaning fluid pumped through the internal cooling passages P of the airfoil components A fixtured on the manifold sections 16*b* is discharged from apertures in the airfoil; e.g. typical trailing edge apertures communicated to the internal cooling passage P, and returns to the sump region 12*b* for recirculation via conduit 33 and pumps 30, 32. Some airfoil components may have an internal passage configuration that begins and ends at the root R. In this event, the cleaning fluid is discharged from the internal passage P where it returns to the root R.

In accordance with a method embodiment of the invention, the engine-run airfoil components to be cleaned are fixtured on the manifold sections 16*b* when the manifold 16 is positioned outside the cleaning chamber 12 on a wheeled carriage or trolley 13 itself mounted on a wheeled shuttle 170. In particular, the airfoil components A are fixtured on the manifold 16 at a remote loading location while the carriage 13 is located on shuttle rails 174 by a pivotable latch 173 thereon engaging the rear lip of the carriage 13. The root end R of each airfoil component A is clamped as described above such that the open end OE of the internal passage P is registered with the associated nozzle discharge end 71*a* and the airfoil tip T is remote from the manifold sections 16*b* as shown in FIGS. 4–5. After the airfoil components are fixtured on the manifold 16, the shuttle 170 is rolled toward the opened loading door 11 of the cleaning chamber 12 to a position determined by a stop 171 and latch mechanism 172 that holds the shuttle in position for loading of the manifold 16 into the cleaning chamber 12. The shuttle 170 includes rail extensions 174*a* that extend into chamber 12 and are aligned with like rails 175 disposed therein.

Then, the carriage 13 is rolled on rail extensions 174*a* onto rails 175 in the cleaning chamber 12 where a pivotable latch 176 engages a rear lip of the carriage 13 to hold the carriage 13 in desired position relative to the fixed cleaning fluid supply conduit 14 so that manifold 16 can be connected thereto via flange clamp 60 and Teffon gasket 61. The latch 176 is pivotably mounted on rail support member 178. After the manifold 16 is connected to the conduit 14 by the flange clamp 60, the door 11 of the housing 10 is closed in preparation for cleaning the airfoil components A. Although not shown, a cam lever can be provided on the rail support member 178 to temporarily lift the manifold 16 slightly to facilitate alignment and connection with the end of the conduit 14.

The engine-run airfoil components A typically have silicon and calcium rich deposits in the internal passages P thereof, although the composition of the deposit will vary considerably in dependence on the environments to which the engine was exposed in use. These Si—Ca rich deposits are removed by an caustic cleaning fluid selected to this end. For purposes of illustration, not limitation, a suitable caustic solution to this end can comprise aqueous 45 volume % KOH or 52 volume % NaOH solutions. However, the caustic cleaning solution can be used in other concentrations selected to remove the deposits depending upon the particular cleaning solution temperatures and flow rates (pressures) employed. That is, the cleaning solution concentration, temperature, pressure, flow rate, and cleaning time are primary parameters that are controlled to achieve effective the removal of Si—Ca rich deposits from the internal passages of the engine-run airfoil components A without adverse attack or damage to the superalloy (if uncoated) from which the airfoil component is made (e.g. cast) or the protective coating on the internal passage walls (if coated).

For the specific caustic cleaning solutions (KOH or NaOH) described above, solution temperatures in the range of 190° to 280° F. can be used, wherein higher temperatures are believed to enhance removal of the deposits. To improve control of the concentration of the caustic solution during the cleaning operation, it is desirable to maintain the temperature of the cleaning solution below its boiling temperature (minimizing water additions).

For the specific caustic cleaning solutions (KOH or NaOH) described above, cleaning fluid pressures in the range of 200 to 400 psi can be used, wherein higher pressures are believed to enhance removal of the deposits. The use of the tandem low pressure and high pressure pumps 30, 32 allows desired cleaning fluid pressure to be provided in the manifold 16. The cleaning fluid pressure can be selected to provide total cleaning fluid flow rates of about 285 to 550 gallons per minute (gpm) through the manifold 16. When 30 engine-run components A are fixtured on the manifold 16, an individual flow rate of 9.5 gpm will be provided through each component A at a cleaning fluid flow rate of 285 gpm. When 50 engine-run components A are fixtured on the manifold, an individual flow rate of 11.1 gpm will be provided through each component A at a cleaning fluid flow rate of 550 gpm. Cleaning fluid flow rates from 7.5 to 20 gpm through each component A can be used in the practice the invention.

The time of cleaning is preferably as short as possible to achieve removal of the deposits from the internal passages of the engine-run airfoil components A. The time of cleaning will vary with the nature (e.g. composition and thickness) of the deposits to be removed. Times from 2 to 10 hours using the specific cleaning parameters described above are typical to achieve removal of the aforementioned Si—Ca rich deposits even when present as thick deposits (e.g. 0.25 inch). Shorter cleaning times are of course desirable.

In removing heavy Si—Ca rich deposits from engine-run first stage JT8D turbine blades cast from PWA1455 nickel base superalloy having uncoated internal passages in accordance with a method of the invention, a 45 volume % KOH solution at a temperature of 250° F. and manifold pressure of 360 psi was flowed at 9.5 gpm through the internal cooling passages of JT8D 1st stage turbine blades for times up to 10 hours. These parameters removed the Si—Ca rich deposits from the internal cooling passages without harmful attack or damage to the superalloy component. Although the JT8D blades cleaned were equiaxed, the invention can be used in cleaning single crystal and directionally solidified engine-run superalloy airfoil components.

Further, engine-run JT9D 1st stage turbine blades were similarly cleaned in as little as 1 hour.

Figure 6:
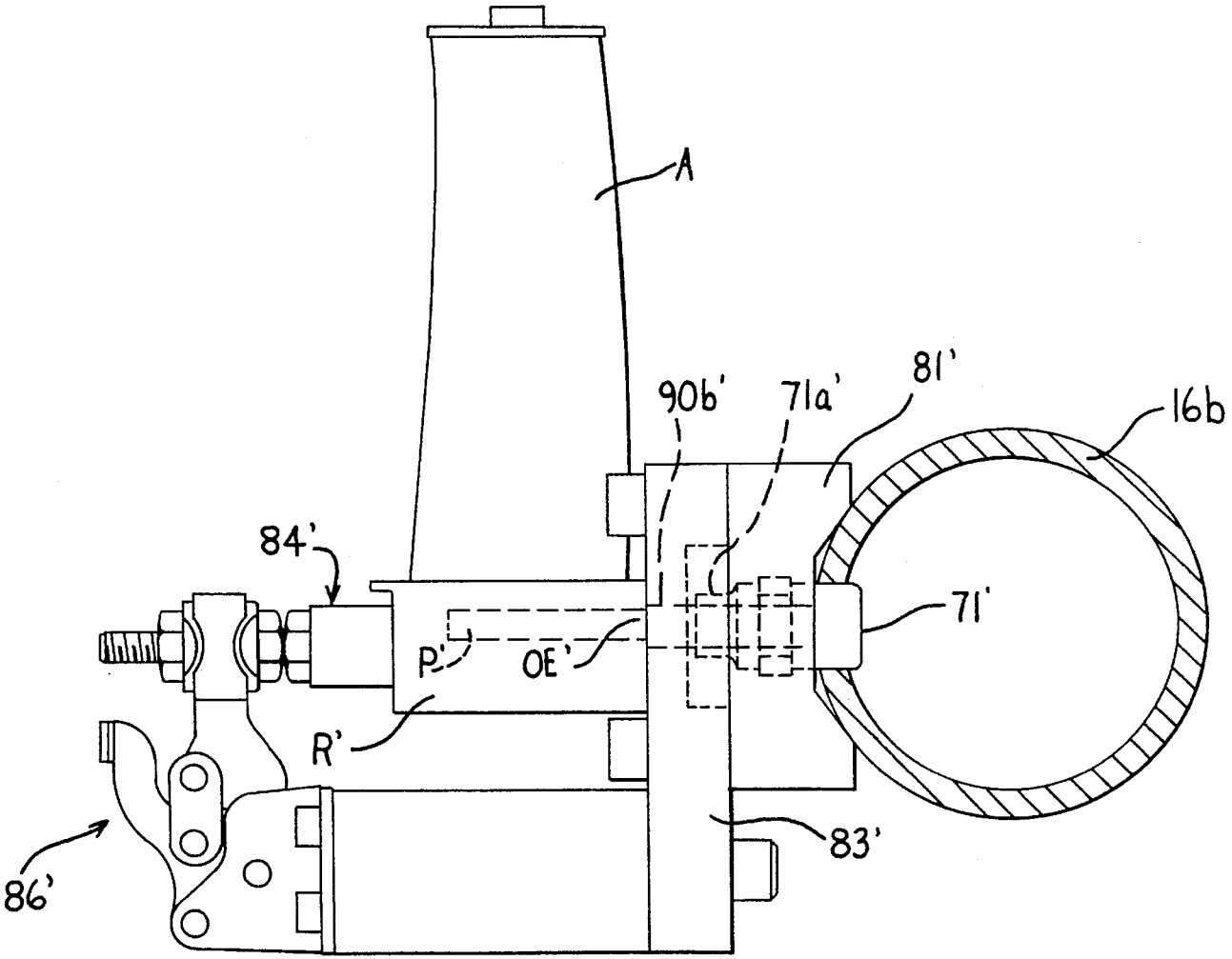
FIG. 6 is a view similar to FIG. 5 showing fixturing of a different (side-opening) airfoil component on the cleaning fluid secondary manifold.
Figure 7:
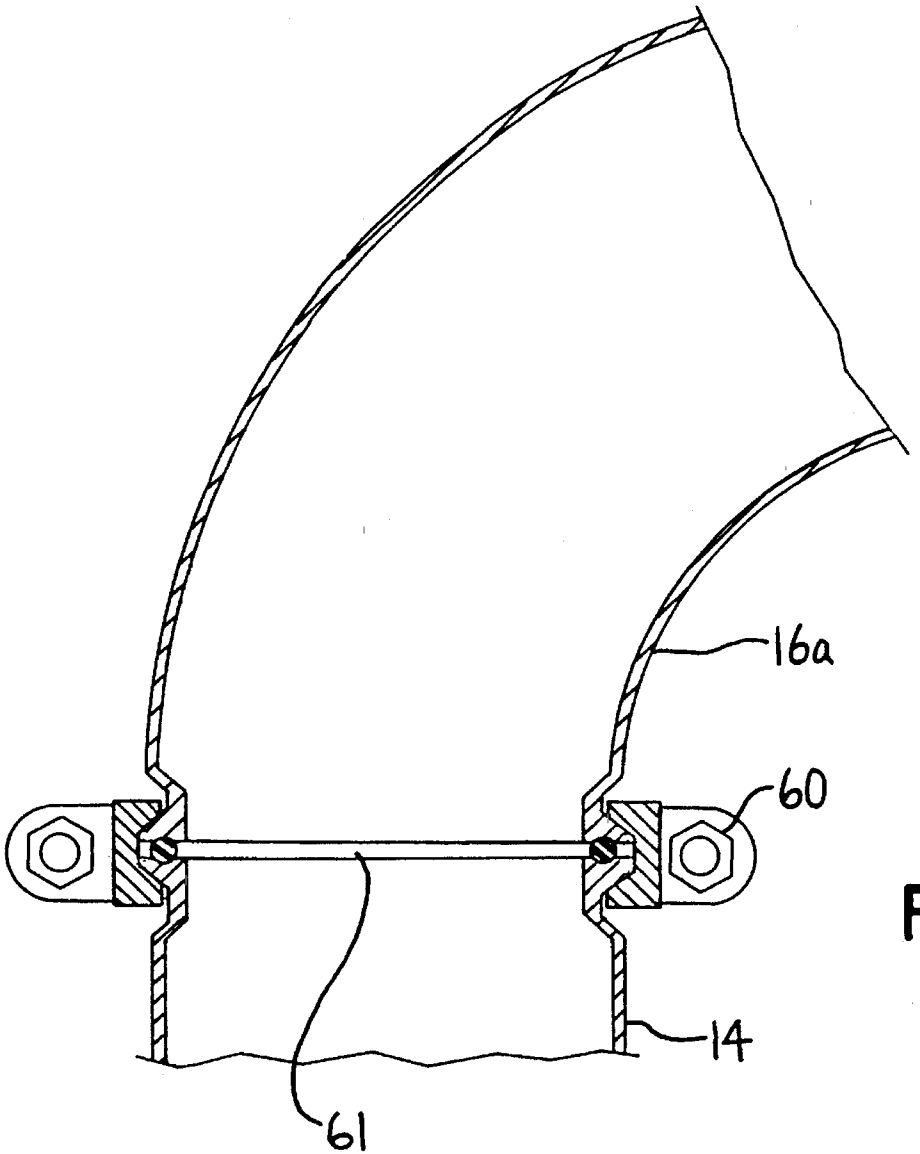
FIG. 7 is a fragmentary sectional view of the ends of the conduit 14 and manifold 16 coupled together by a clamp.

Referring to FIG. 6 wherein like features are represented by like reference numerals primed, engine-run airfoil components A' (e.g. JT9D blades) are shown including a side opening passage P'. In practicing the invention to clean such side-opening airfoil components, each component A' is mounted on its side to communicate the open passage end OE' to the cleaning fluid spray nozzle 71' on the manifold section 16*b'* in the manner illustrated in FIG. 6.

After the airfoil components are cleaned pursuant to the invention, they typically are rinsed in the housing 10 with water supplied by manifold 51 to the aforementioned diagonally extending spray bar (not shown) thereabove to remove residual cleaning solution from their exterior surfaces and also from exterior surfaces of the manifold 16.

The airfoil components are then removed from the housing 10 on carriage 13/shuttle 170 and transported to a water blast unit (not shown) of conventional construction where water, at high pressure is pumped through the components. Water pressures of 800 psi and 7000 psi can be used at the water blast unit.

The airfoil components A are then immersed for 1 hour in hot water at 140°–200° F. followed by oven drying at 300°–400° F. to complete the cleaning operation.

Although the invention has been described in terms of specific embodiments thereof, it is understood that modifications and changes can be made thereto within the scope of the invention and appended claims.

The embodiments of the invention in which an exclusive property or privilege is claimed are defined as follows:

1. Method for removing deposits from internal passages of a plurality of gas turbine engine-run airfoil components, comprising:

fixturing a plurality of said engine-run components on a cleaning fluid manifold with the internal passage of each component having a gas turbine engine-run deposit therein and with said internal passage communicated to a respective cleaning fluid spray nozzle on said cleaning fluid manifold, pumping a heated caustic cleaning fluid to the manifold for flow through each nozzle and discharge to the internal passage of each component for flow through said internal passage for a time to remove said deposit therefrom, and discharging the heated cleaning fluid from said internal passage of each said component.

2. The method of claim 1 wherein the heated cleaning fluid is pumped through the internal passage at a flow rate between 7.5 and 20 gallons per minute.

3. The method of claim 2 wherein the heated cleaning fluid is pumped at a pressure of between 200 to 400 psi.

4. The method of claim 1 wherein the heated cleaning fluid comprises an aqueous alkaline earth hydroxide solution at a temperature below its solution boiling point.

5. The method of claim 1 including fixturing the components on the cleaning fluid manifold outside a cleaning chamber, positioning the manifold in the cleaning chamber, and connecting the cleaning fluid manifold to a cleaning fluid pump supply conduit.

6. The method of claim 1 Wherein each engine-run component is fixtured on the cleaning fluid manifold above the spray nozzle with the internal passage registered in communication with a discharge end of the spray nozzle so as to receive cleaning fluid sprayed therefrom.

7. Method for removing deposits from internal passages of a plurality of gas turbine engine-run airfoil components, comprising:

fixturing a plurality of said engine-run airfoil components on a cleaning fluid manifold with the internal passage of each component having a gas turbine engine-run deposit therein and with said internal passage communicated to a respective cleaning fluid spray nozzle on said cleaning fluid manifold, positioning the cleaning fluid manifold in a cleaning chamber having a sump, including connecting the manifold to a cleaning fluid supply conduit in the chamber, pumping a heated caustic cleaning fluid from said sump to the supply conduit for flow through the manifold through each nozzle and discharge to the internal passage of each component for flow through said internal passage for a time to remove said deposit therefrom, and discharging the heated cleaning fluid from the internal passage of each said component into the sump of the cleaning chamber for pumping back to the cleaning manifold.

8. The method of claim 7 wherein the cleaning fluid is heated in the sump of said cleaning chamber.

9. The method of claim 7 wherein the heated cleaning fluid is pumped at a pressure between 200 to 400 psi.

10. The method of claim 7 wherein each engine-run component is fixtured on the cleaning fluid manifold above the spray nozzle with the internal passage registered in communication with a discharge end of the spray nozzle so as to receive cleaning fluid sprayed therefrom.

11. In the repair of gas turbine engine-run airfoil components, an improved method for removing deposits from internal passages of a plurality of said gas turbine engine-run airfoil components, comprising:

fixturing a plurality of said engine-run airfoil components on a cleaning fluid manifold disposed in a cleaning chamber with the internal passage of each component having a gas turbine engine-run deposit therein and with said internal passage communicated to a respective cleaning fluid spray nozzle on said cleaning fluid manifold, pumping a heated aqueous caustic hydroxide solution as said cleaning fluid having a temperature from about 200° to about 250° C. to the manifold at a flow rate of between about 7.5 and 20 gallons per minute and pressure of about 200 and 400 psi for flow through each nozzle and discharge to the internal passage of each component for flow through said internal passage for a time to remove said deposit therefrom, and discharging the heated cleaning fluid from the internal passage of each said component into the cleaning chamber.

12. Method of removing deposits from internal passages of a plurality of gas turbine engine-run airfoil components, comprising:

fixturing a plurality of said engine-run airfoil components relative to cleaning fluid supply means such that the internal passage of each component having a gas turbine engine-run deposit therein is communicated to cleaning fluid supply means, and pumping heated caustic cleaning fluid to the cleaning fluid supply means for supply to each internal passage for flow through said internal passage for a time to remove the gas turbine engine-run deposit therefrom.

13. The method of claim 12 wherein the cleaning fluid is supplied to the internal passage at a flow rate between 7.5 and 20 gallons per minute.

14. The method of claim 13 wherein the cleaning fluid is pumped to the cleaning fluid supply means at a pressure of between 200 to 400 psi.

* * * * *